United States Patent [19]

Ruth

[11] Patent Number: 4,490,703

[45] Date of Patent: Dec. 25, 1984

[54] MULTIPOLE MAGNET FOR ELECTRON BEAM CORRECTION

[75] Inventor: Roy L. Ruth, Meundsview, Minn.

[73] Assignee: Ball Corporation, Muncie, Ind.

[21] Appl. No.: 402,655

[22] Filed: Jul. 28, 1982

[51] Int. Cl.[3] ..... H01F 7/02

[52] U.S. Cl. ..... 335/212; 335/210; 313/431

[58] Field of Search ..... 335/210, 212; 313/421, 313/425, 426, 427, 428, 431

[56] References Cited

U.S. PATENT DOCUMENTS

| | | | |
|---|---|---|---|
| 2,903,327 | 9/1959 | Weber | 18/47 |
| 2,980,814 | 4/1961 | Vasilevskis | 313/75 |
| 3,184,654 | 5/1965 | Bey | 317/159 |
| 3,191,104 | 6/1965 | Mak | 335/210 |
| 3,335,377 | 8/1967 | Kohlhagen | 335/284 |
| 3,375,389 | 3/1968 | Hughes | 335/212 |
| 3,514,729 | 5/1970 | Webb | 335/207 |
| 3,701,065 | 10/1972 | Mirsch | 335/212 |
| 3,873,953 | 3/1975 | Puhak | 335/212 |
| 3,898,597 | 8/1975 | Vonk | 335/210 X |
| 4,091,347 | 5/1978 | Barbin | 335/212 |
| 4,162,470 | 7/1979 | Smith | 335/284 X |
| 4,295,110 | 10/1981 | Uesaka et al. | 335/212 |

*Primary Examiner*—George Harris

*Attorney, Agent, or Firm*—Gilbert E. Alberding

[57] ABSTRACT

A permanent magnet used in conjunction with electron beam correction is disclosed which is disk-shaped and exhibits in the plane of the disk an asymmetric quadrapole magnetic field. The strength of the magnetic field between any two adjacent poles is proportional to the distance between the two poles giving four magnetic fields of differing strength in view of the differing distances between the four magnetic poles around the periphery of the disk. A plurality of such magnets can be supported adjacent the envelope of a cathode ray tube to achieve electron beam centering, multiple beam convergence, and the like.

14 Claims, 4 Drawing Figures

MULTIPOLE MAGNET FOR ELECTRON BEAM CORRECTION

The present invention relates generally to permanent magnets and their use to deflect electrons or ion beams. The invention relates more particularly to permanent magnets which are adjustably positioned with respect to a cathode ray tube so as to achieve electron beam centering, multiple-beam convergence, and the like.

The use of adjustably positioned, disk-shaped, permanent magnets in connection with cathode ray tubes for beam centering, multiple-beam convergence, and the like is well known. By way of example, Uetake et al U.S. Pat. No. 3,296,570 discloses a device for correcting the distortion of deflection in television picture tubes. The device consists essentially of a strip of brass sheet formed into an annular supporting ring surrounding the deflection coil on the back of the picture tube. Four C-shaped holders are mounted on the supporting ring and within each C-shaped holder is situated a disk-shaped permanent magnet. The permanent magnet has a central square hole into which an appropriate tool may be inserted for the purpose of rotating the magnet about its longitudinal axis. The disk-shaped permanent magnets are said to have a north and a south pole on a peripheral surface and the north and south poles are illustrated to be diametrically opposite each other.

A further example of the prior art is found in Chandler et al U.S. Pat. No. 3,106,658 which shows a similar ring-like holder 21 composed of four ferromagnetic strips placed end-to-end circumferentially around the cone of the picure tube. Four disk-shaped magnets which are said to be polarized along a diameter of the disk are fixed to the circumferential support ring by an appropriate bracket. The Chandler support ring of ferromagnetic material is intended to more actively couple the magnetic field provided by the four magnets than did the brass-supporting ring of the Uetake apparatus.

A further example is found in Takenaka et al U.S. Pat. No. 4,197,487 which discloses a ring-like support surrounding the deflection yoke of a picture tube which includes six permanent magnets, each of which comprises a disk-shaped permanent magnet having a pair of poles a gain shown to be diametrically opposed. In each of the disclosures, it is assumed that the magnets are to be adjusted so as to focus, deflect, or converge the electron beam or beams within the picture tube.

While disk-shaped bi-polar magnets are usually employed as disclosed in the foregoing discussed patents, the use of ball-shaped permanent magnets having a quadrapole field is shown in Werst U.S. Pat. No. 4,232,283. The function of the ball-shaped quadrapole magnets is for color convergence and is said to have the advantage over a two-pole magnetized sphere in that the rate of decrease of magnetic field intensity with distance from the center of a magnetized sphere is greater with a four-pole configuration than with a two-pole configuration. Hence, less undesirable motion is exhibited by the further away electron beams. The quadrapole magnetized spheres are employed in combination with a magnetized strip affixed to the neck of the color picture tube and further in combination with a conventional interior two-pole purity correcting ring.

Despite the variations in geometry variously attempted in the prior art, certain problems remain. Of particular concern is the correction of the CRT display geometry with the aid of selected permanent magnets without creating electron beam distortion at the extreme deflection points which often causes the loss of resolution in these areas. Typically, many different yoke designs are required for each particular application of a CRT and different types of CRTs,thus reducing the cost-effective volume needed in yoke manufacturing. The use of di-polar electromagnets is unsatisfactory in that they consume a large amount of DC power, are expensive to manufacture, and are only as stable as the power supply from which they obtain their DC current. Fixed di-polar magnets are superior to electromagnets but still cause difficulties if their fixes field strength is more or less than required for the particular application. Hence, a large inventory of various field strength permanent magnets is necessarily maintained so that an appropriate field strength magnet may be selected from the inventory and applied to an appropriate holder. Further, the selection must be made with the end use in mind since differing field strengths are required for the various CRT applications and CRT types which might be employed with a given deflection yoke.

To solve these problems, magnetic elements in accordance with the present invention are used to control the path of electrons within a cathode ray tube. A magnetic element of the present invention comprises a disk-shaped permanent magnet which has in the plane of the disk an asymmetric multipole, and preferably asymmetric quadrapole magnetic field. The asymmetry of the magnetic field is preferably such that the distance between any two adjacent poles on any one magnet is not equal to the distance between any other two adjacent poles on the same magnet. In this manner, four or more discrete field stengths of differing magnitude are achievable with the strength of the field between any two adjacent poles being proportional to the distance between the poles.

By having a single permanent magnet with four different field strengths, it becomes possible to significantly diminish the necessary inventory of magnets to be employed. Further, a given yoke with magnets of the present invention may be used on a wider variety of CRTs in various CRT applications. The disk-shaped asymmetrically magnetized quadrapole magnets are preferably adjustably mounted on a support with respect to the CRT such that an appropriate field strengh may be selected and the polarity of that field may be reversed by reversing the magnet position. In this manner, closer tolerance to CRT display requirements can be satisfied because of the diversity of field strengths and adjustment capabilities of the magnet.

Additional features and advantages of the invention will become apparent to those skilled in the art upon consideration of the following detailed description of preferred embodiments exemplifying the best mode of carrying out the invention as presently perceived. The detailed description particularly refers to the accompanying figures in which.

As shown in the accompanying figures, a magnetic element 10 according to the present invention comprises a disk 12 of ceramic ferrite or polymer bonded ferrite. The disk 12 can include a hole 14 to aid in mounting of the disk to an appropriate holder 16. The disk 12 has the following typical dimensions: an outside diameter of 0.500 inch, a hole diameter of 0.187 inch, and a thickness of 0.125 inch.

The ferrite disk 12 is subjected to a saturizing magnetic field provided by a magnetizer such as an Indiana General CH40 which has been modified to apply an asymmetric quadrapole field to the disk. Once magnetized, the magnetic element 10 exhibits two north poles and two south poles alternately spaced around the periphery of the element. The angular distance between the poles is arranged at conveniently chosen angles of unequal magnitude. Two examples of particular utility are illustrated in FIGS. 2 and 3.

Generally, where a field is applied at an angle of less than about 30°, the exhibited permanent magnetization is insufficiently stable. It is believed that this is due to the fact that the applied field is too short to penetrate the entire radius of the disk, and thus all of the magnetic domains in that less than 30° segment do not respond to the applied saturating field. Since the same saturating magnetic field is applied simultaneously to all poles of element 10, the resulting permanent magnetic field between any two adjcent poles is proportional to the angular distance between the two poles.

Figure 1:
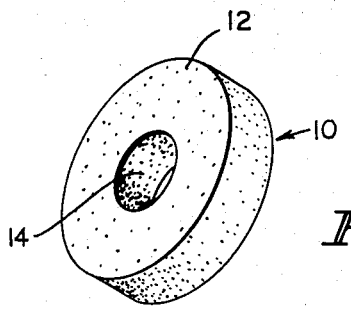
FIG. 1 is a perspective view of a magnetic element in accordance with the present invention.
Figure 2:
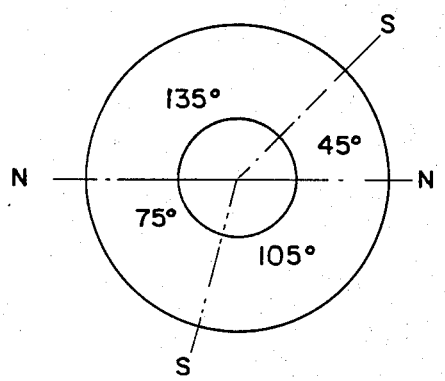
FIG. 2 is a schematic view of one preferred embodiment showing the magnetic pole distribution.
Figure 3:
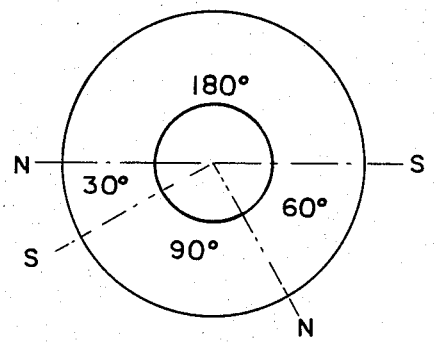
FIG. 3 is a schematic view of another preferred embodiment of the invention showing a different magnetic pole distribution.

In the embodiment illustrated in FIG. 2, two poles of like polarity, for example, north, are situated directly opposite each other on the periphery of the disk. In the embodiment shown in FIG. 3, two poles of opposite polarity are situated directly opposite each other on the periphery of the disk. In either case, the distance measured along the periphery of the disk between any adjacent two poles is different from the distance similarly measured between any other adjacent two poles. In view of the fact that the polarizing field is simultaneously applied, the four magnetic poles on the periphery of the disk are each of different field strength since the domains contributing to the field strength are different in number.

Figure 4:
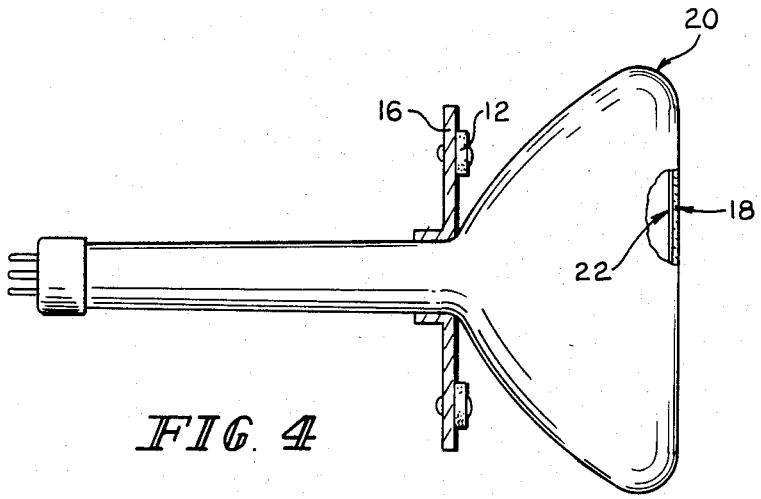
FIG. 4 is a side elevation view of magnetic elements in accordance with the present invention situated on a holder in operable position on a CRT.

FIG. 4 shows a typical use of magnetic elements of the present invention for altering the path of electrons travelling longitudinally within the envelope 18 of a cathode ray tube 20. A support 16 supports at least one, and typically a plurality of three to twelve, of the magnetic element 12 adjacent to the envelope 18. The support 16 can be of conventional design or, alternatively, may be of a novel design addressed in a contemporaneously filed patent application of Roy L. Ruth and Kimberly A. Paddock, Ser. No. 439,696 filed on Nov. 8, 1982, and entitled, MAGNET SUPPORT COLLAR, which application is assigned to the same assignee as the present case. The magnetic elements 12 are preferably adjustably supported on the support 16 so that by manipulation of the magnetic element 12 the electron beam within the cathode ray 20 may be focussed on the screen 22 of the tube.

Although the invention has been described in detail with reference to certain perferred embodiments and specific examples, variations and modifications exist within the scope and spirit of the invention as described above and as defined in the following claims.

What is claimed is:

1. A magnetic element for use with a cathode ray tube to control the path of electrons within the tube, the element comprising a disk-shaped permanent magnet having, in the plane of the disk, an asymmetric quadrapole magnetic field, the distance measured along the periphery of the disk between any adjacent two poles being different from the distance measured along the periphery of the disk between any other adjacent two poles.

2. The magnetic element of claim 1 wherein two poles of like polarity are situated directly opposite each other on the periphery of the disk.

3. The magnetic element of claim 1 wherein two poles of opposite polarity are situated directly opposite each other on the periphery of the disk.

4. The magnetic element of claim 1 wherein the four magnetic poles are each of different field strength.

5. The magnetic element of claim 1 wherein the disk-shaped element consists essentially of a material selected from the group consisting of ceramic ferrite and polymer-bonded ferrite.

6. A magnetic element for use with a cathode ray tube to control the path of electrons within the tube, the element comprising a disk-shaped permanent magnet having in the plane of the disk an asymmetric multi-pole magnetic field, the distance measured along the periphery of the disk between any adjacent two poles being different from the distance measured along the periphery of the disk between any other adjacent two poles.

7. An apparatus for altering the path of electrons travelling longitudinally within the envelope of a cathode ray tube, the apparatus comprising a support for supporting a plurality of magnetic elements adjacent the envelope of the cathode ray tube, and a plurality of magnetic elements supported by the support, each magnetic element comprising a disk-shaped permanent magnet having in the plane of the disk an asymmetric multi-pole magnetic field.

8. The magnetic element of claim 1 wherein said magnetic element comprises two north poles and two south poles alternately spaced around the periphery of the disk.

9. The magnetic element of claim 6 wherein the poles on said disk are each of different field strength.

10. An apparatus as recited in claim 7 and further including means for adjustably supporting each of said plurality of magnetic elements for controlling the path of said electrons.

11. An apparatus as recited in claim 10 wherein said adjusting means includes means for rotatably supporting each of said plurality of magnetic elements.

12. Apparatus for controlling the path of electrons travelling within the envelope of a cathode ray tube comprising:

a plurality of disk-shaped permanent magnets, each of said magnets having in the plane of the disk an asymmetric quadrapole magnetic field in which the distance, measured along the periphery of the disk, between any two adjacent poles on each disk is different from the distance, measured along the periphery of the disk, between any other two adjacent poles on the same disk, and in which each of the four poles on the periphery of the disk is of different field strength;

means for supporting said plurality of disk-shaped permanent magnets adjacent the envelope of said cathode ray tube; and means for rotating each of said plurality of disk-shaped permanent magnets for adjusting the magnetic field within said envelope to control the path of said electrons travelling within said envelope.

13. An apparatus for altering the path of electrons travelling within the envelope of a cathode ray tube, said apparatus comprising:

at least one magnetic element comprising a disk-shaped, permanent magnet having in the plane of the disk an asymmetric, multi-pole, magnetic field, the distance measured along the periphery of the disk between any adjacent two poles being different from the distance measured along the periphery of the disk between any other adjacent two poles; and means for adjustably supporting said magnetic element adjacent the envelope of a cathode-ray tube for controlling the path of said electrons.

14. The magnetic element of claim 13 wherein the poles on said disk are each of different field strength.

* * * * *